United States Patent [19]

Harper et al.

[11] Patent Number: 4,816,717

[45] Date of Patent: Mar. 28, 1989

[54] ELECTROLUMINESCENT LAMP HAVING A POLYMER PHOSPHOR LAYER FORMED IN SUBSTANTIALLY A NON-CROSSED LINKED STATE

[75] Inventors: William P. Harper, South Killingly; Michael S. Lunt, Abbington, both of Conn.

[73] Assignee: Rogers Corporation, Rogers, Conn.

[21] Appl. No.: 206,183

[22] Filed: Jun. 13, 1988

Related U.S. Application Data

[63] Continuation of Ser. No. 696,039, Jan. 29, 1985, abandoned, which is a continuation-in-part of Ser. No. 577,145, Feb. 6, 1984, abandoned.

[51] Int. Cl.[4] ..... H05B 33/14; H05B 33/20

[52] U.S. Cl. ..... 313/502; 313/503

[58] Field of Search ..... 313/502, 506, 509, 498, 313/512, 503, 504; 252/301.35, 301.16

[56] References Cited

U.S. PATENT DOCUMENTS

| | | | |
|---|---|---|---|
| 2,721,153 | 10/1955 | Hopf et al. | 117/212 |
| 2,752,331 | 6/1956 | Dittman et al. | 260/87.7 |
| 2,866,764 | 12/1958 | West et al. | 260/30.4 |
| 2,875,105 | 2/1959 | Troester | 117/218 |
| 2,941,104 | 6/1960 | Swindells | 313/108 |
| 2,990,294 | 6/1961 | Long | 117/75 |
| 3,010,044 | 11/1961 | Cerulli | 313/502 |
| 3,247,414 | 4/1966 | Levetan | 313/108 |
| 3,315,111 | 4/1967 | Jaffe et al. | 313/108 |
| 3,421,037 | 1/1969 | Dymon | 313/509 X |
| 3,470,014 | 9/1969 | Koblitz et al. | 117/72 |
| 3,490,946 | 1/1970 | Wolff | 117/235 |
| 3,498,939 | 3/1970 | Schier et al. | 260/19 |
| 3,850,631 | 11/1974 | Tamai | 96/1.5 |
| 4,045,636 | 8/1977 | Yoder et al. | 200/292 |
| 4,121,001 | 11/1978 | Gotcher et al. | 428/35 |
| 4,159,559 | 7/1979 | Robinson, Sr. | 29/25.14 |
| 4,187,339 | 2/1980 | Cayrol | 428/208 |
| 4,266,223 | 5/1981 | Frame | 340/719 |
| 4,273,829 | 6/1981 | Perreault | 428/383 |
| 4,314,231 | 2/1982 | Walty | 338/328 |
| 4,376,145 | 3/1983 | Frame | 428/195 |
| 4,417,174 | 11/1983 | Kamijo et al. | 313/502 |
| 4,455,324 | 6/1984 | Kamijo et al. | 427/66 |

FOREIGN PATENT DOCUMENTS 1059678 7/1979 Canada .

OTHER PUBLICATIONS

Encyclopedia of Polymer Science and Technology, vol. 14, (1971) pp. 600–610.

Howard, Webster E., "Electroluminescent Display Technologies and Their Characteristics", Proceedings of the SID, vol. 22, No. 1 (1981), pp. 47–56.

"Technical Date-Solvents for Kynar", Pennwalt Corporation, Jan. 31, 1974 (No Date).

"Technical Date-Kynar", Pennwalt Corporation, Apr. 1, 1970.

*Primary Examiner*—Kenneth Wieder

[57] ABSTRACT

The invention provides electroluminescent lamps that contain light-emitting phosphors and covering layers which have unusual durability, light transmissivity and resistance to moisture using simple screen printing and doctor blade coating techniques. It is discovered that a liquid dispersion of thermoplastic polymer powder particles, e.g. predominantly of polyvinylidene fluoride, simultaneously: (a) can suspend electrical property additives, such as crystalline, hard, dense particles of generally spherical shape, uniformly in desired concentrations (b) while containing a useful concentration of any of a wide range of such particles, can be deposited by high shear transfer to a substrate in accurately controllable thickness and contour; (c) when so deposited can be fused into a continuous uniform film which has low absorptivity, e.g. of moisture and acts as a barrier film; (d) can, as one layer, be fused with other such layers, containing other electrical property additives, to form a monolithic electrical component; and, (e) in general, can meet all requirements for the making of electroluminescent lamps.

11 Claims, 2 Drawing Sheets

ELECTROLUMINESCENT LAMP HAVING A POLYMER PHOSPHOR LAYER FORMED IN SUBSTANTIALLY A NON-CROSSED LINKED STATE

This is a continuation of application Ser. No. 696.039 filed Jan. 29, 1985, now abandoned, which was a continuation-in-part of application Ser. No. 577,145 filed Feb 6, 1984, also now abandoned.

BACKGROUND OF THE INVENTION

This invention relates to electroluminescent lamps, which typically are formed of a phosphor-particle-containing layer disposed between corresponding electrodes adapted to apply an excitation potential to the phosphor particles, at least one of the electrode layers being semi-transparent to light emitted by the phosphors.

The phosphor-containing layer is provided with a barrier against moisture penetration to prevent premature deterioration of the phosphors, and permanent adherence between adjacent layers is sought to avoid delamination, e.g. under constant flexing or changes in temperature, particularly where the layers are of materials having different physical properties as this can also lead to premature failure in prior art electroluminescent lamps.

In one major application, i.e. for lighting membrane keyboards, the layers of the lamp and the supporting substrate must be flexible.

SUMMARY OF THE INVENTION

According to the invention it has been discovered that a liquid dispersion of thermoplastic powder particles comprised, e.g., of polyvinylidene fluoride (PVDF), simultaneously:

(a) can suspend uniformly in desired concentrations any of a wide variety of electrical property additives, including crystalline, hard, dense particles that are generally spherical in shape, (b) while containing a useful concentration of such particles, can be deposited by high shear transfer to a substrate in accurately controllable thickness and contour, (c) when so deposited can be fused into a continuous, uniform, barrier film, the film itself having low absorptivity, e.g., of moisture, (d) can, as one layer, be fused with other such layers, containing other electrical property additives, to form a monolithic electrical component, and (e) in general, can meet all requirements for the making of electroluminescent lamps including layers with additives harmed, e.g., by the presence of moisture, by printing and coating with a high degree of accuracy and controllability.

The discovery can be employed to form lamps that are highly resistant to ambient heat and moisture and other conditions of use. Despite markedly different electrical properties between layers, the PVDF binding polymer is found to be capable of a controllable degree of interlayer penetration during fusing, which on the one hand is sufficient to provide monolithic properties, enabling, e.g., repeated bending without delamination, while on the other hand is sufficiently limited to avoid adverse mixing effects between different electrical additives in adjacent layers. PVDF can be employed as the binder with additive particles having widely different physical properties in adjacent layers, while the overall multilayer deposit exhibits the same coefficient of expansion, the same reaction to moisture, and a common processing temperature throughout. Thus each layer can be made under optimum conditions without harm to other layers and the entire system will respond uniformly to conditions of use.

Remarkable results have been obtained by the simple techniques of silk screen printing and doctor blade coating of successive layers. Of special importance, it has been discovered that layers that contain light emitting phosphors and covering electrode and protective layers can be made which have unusual light emissivity, durability and moisture resistance. The sensitivity of phosphors, e.g. to moisture, makes this a particularly important discovery.

The invention accordingly features a method of forming an electroluminescent lamp by depositing by shear transfer on a substrate, and drying, thin layers of a suspension of polymer solid dispersed in a liquid phase, the predominant constituent of the polymer particles being polyvinylidene fluoride (PVDF), one of the layers containing a uniform dispersion of phosphor particles, and another of the layers containing an electrically conductive substance, so provided that the layer when dried is transmissive to light emitted by the phosphor particles, the method including heating to fuse the polymer particles continuously throughout the extent of the layers and between the layers, to form a monolithic unit.

In preferred embodiments of the method, the layer is deposited by silk screen printing or doctor blade coating; each layer, preceding the application of the next, is heated sufficiently to fuse the polymer particles to form a continuous film-like layer; the predominant constituent of the liquid phase has substantially no solubility for the polymer under the conditions of its deposit; the liquid phase is predominantly formed from one or more members selected from the group consisting of methyl isobutyl ketone (MIBK), butyl acetate, cyclohexanone, diacetone alcohol, diisobutyl ketone, butyrolactone, tetraethyl urea, isophorone, triethyl phosphate, carbitol acetate, propylene carbonate, and dimethyl phthalate, preferably the liquid phase includes a minor amount of active solvent selected to promote the suspension of the polymer particles in the liquid phase without substantially dissolving the polymer, more preferably the liquid phase includes a minor amount of one or more members selected from the group consisting of acetone, tetrahydrofuran (THF), methyl ethyl ketone (MEK), dimethyl formamide (DMF), dimethyl acetamide (DMAC), tetramethyl urea and trimethyl phosphate, in quantity to promote the suspension of the polymer particles in the liquid without substantially dissolving the polymer; and the liquid dispersion for on of the layers exhibits a substantial reduction in viscosity under high shear stress and the layer is deposited by high shear transfer, preferably the layer is deposited by silk screen printing or by blade coating.

Other features and advantages of the invention will be apparent from the following description of the preferred embodiment, and from the claims.

PREFERRED EMBODIMENT

We first briefly describe the drawings.

Lamp Manufacture

Figure 1:
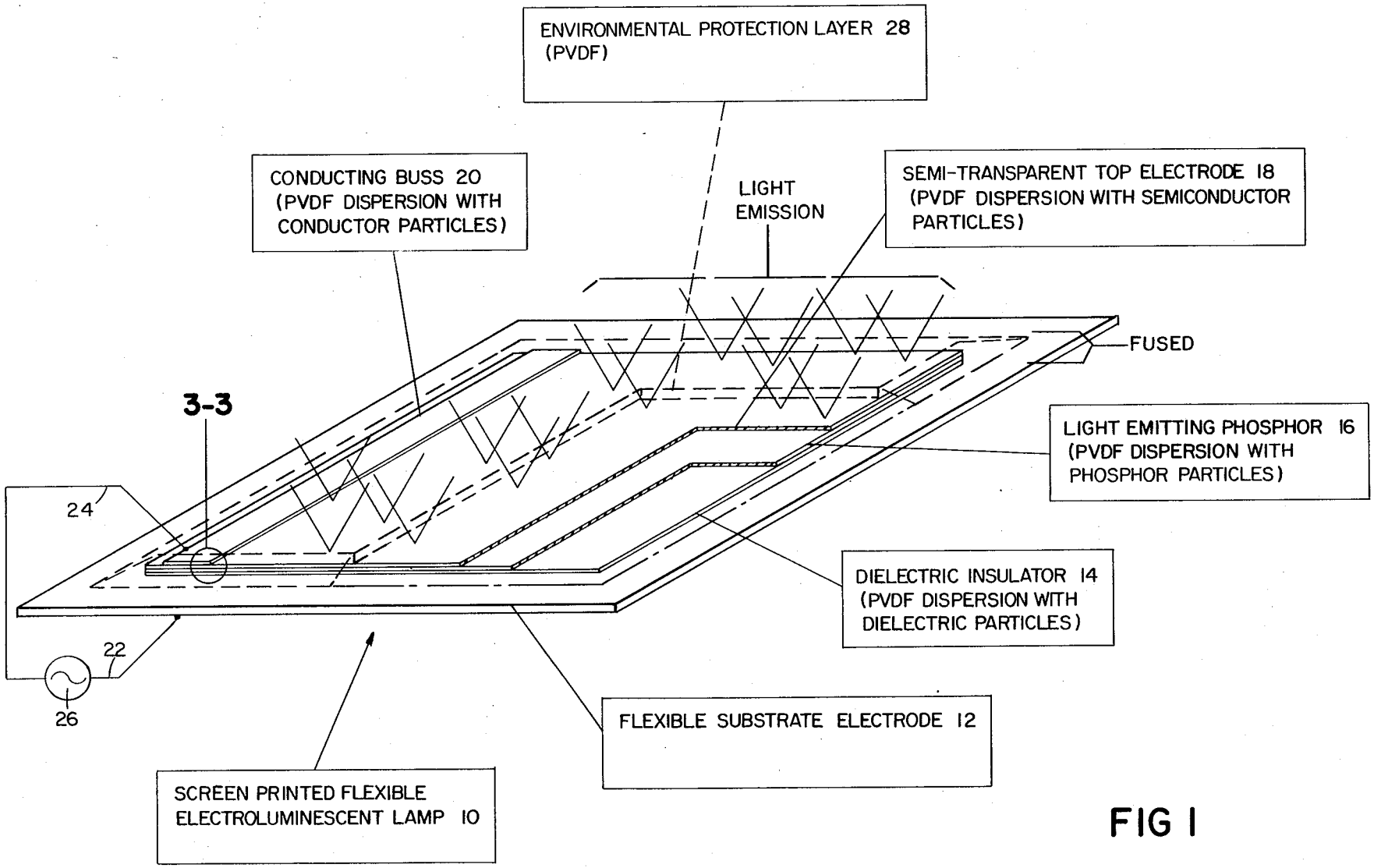
FIG. 1 is a perspective view in section of an electroluminescent lamp formed according to the invention.
Figure 2:
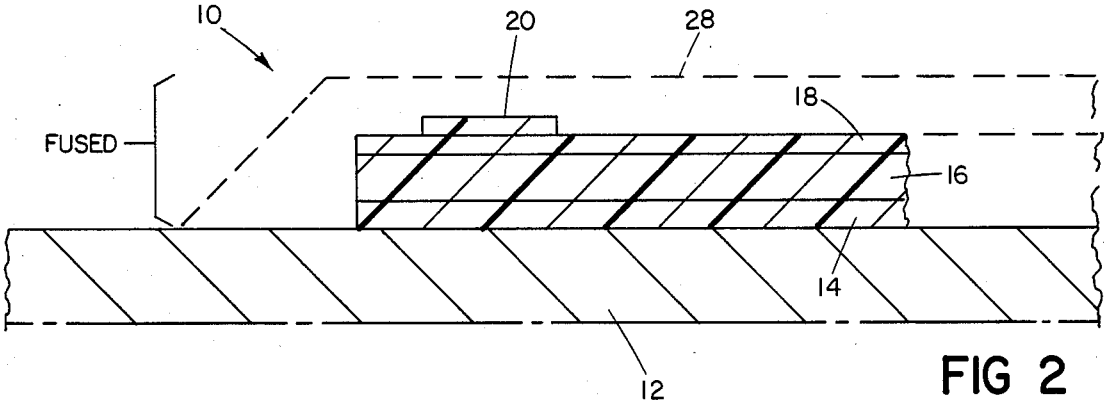
FIG. 2 is a side section view of the lamp taken at the line 2—2 of FIG. 1.
Figure 3:
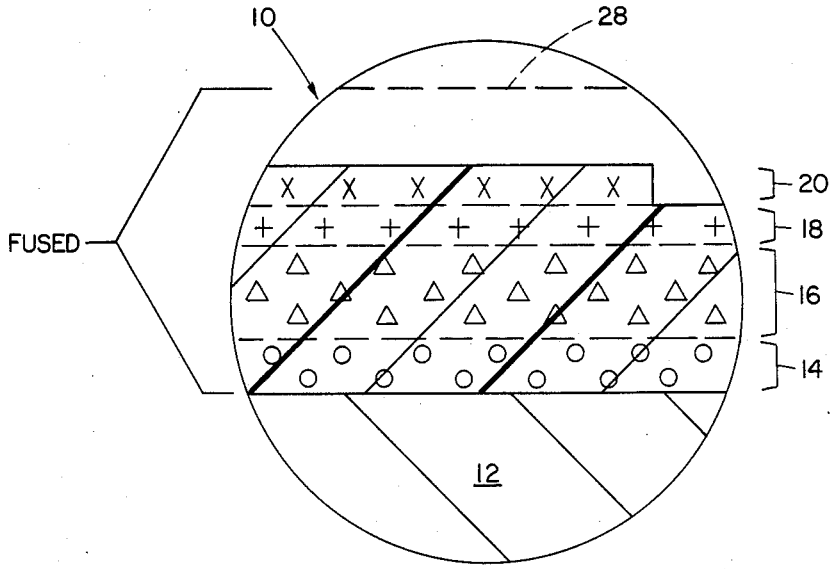
FIG. 3 is side section view of a portion of side the lamp indicated in of FIG. 1, enlarged as viewed through a microscope.

Referring to FIG. 1, we describe an electroluminescent lamp 10 formed of a superposed series of layers. The substrate 12 used in this lamp configuration was copper (0.0014 inch thick, one ounce) cut to the desired size and shape, e.g., 3 inches by 4 inches, selected for its resistance to the carrier fluid employed and for its ability to withstand the extreme temperatures of treatment, e.g. up to 500° F.

A coating composition for forming dielectric layer 14 upon the substrate 12, in this case to act as an insulator between the substrate/electrode 12 and the overlying light emitting phosphor layer 60 (described below), was prepared as follows:

Dielectric Insulating Layer (14)

To prepare the dielectric composition, 10 grams of a PVDF dispersion of 45 percent, by weight, polyvinylidene fluoride (PVDF) in a liquid phase believed to be primarily carbitol acetate (diethyl glycol monoethyl ether) were measured out. This dispersion was obtained commercially from Pennwalt Corporation under the tradename "Kynar Type 202". As the electrical property imparting additive, 18.2 grams of barium titanate particles (BT206 supplied by Fuji Titanium, having a particle size of less than about 5 microns) were mixed into the PVDF dispersion. An additional amount of carbitol acetate (4.65 grams) was added to the composition to maintain the level of solids and the viscosity of the composition at a proper level to maintain uniform dispersion of the additive particles while preserving the desired transfer performance. It was observed after mixing that the composition was thick and creamy and that the additive particles remained generally uniformly suspended in the dispersion without significant settling during the time required to prepare the example. This is due, at least in part, to the number of solid PVDF particles (typically less than about 5 microns in diameter) present in the composition.

The composition was poured onto a 320 mesh polyester screen positioned 0.145 inch above the substrate. Due to its high apparent viscosity, the composition remained on the screen without leaking through until the squeegee was passed over the screen exerting shear stress on the fluid composition causing it to shear thin due to its thixotropic character and pass through the screen to be printed, forming a thin layer on the substrate below. The deposited layer was subjected to drying for 2½ minutes at 175° F. to drive off a portion of the liquid phase, and was then subjected to heating to 500° F. (above the initial melting point of the PVDF) and was maintained at that temperature for 45 seconds. This heating drove off remaining liquid phase and also fused the PVDF into a continuous smooth film on the substrate.

The resulting thickness of the dried polymeric layer was 0.35 mil ($3.5\times10^{-4}$ inch).

A second layer of the composition was screen-printed over the first layer on the substrate. The substrate now coated with both layers was again subjected to heating as above. This second heating step caused the separately applied PVDF layers to fuse together. The final product was a monolithic dielectric unit having a thickness of 0.7 mil with no apparent interface between the layers of polymer, as determined by examination of a cross section under microscope. The particles of the additive were found to be uniformly distributed throughout the deposit.

The monolithic unit 14 was determined to have a dielectric constant of about 30.

A coating composition for forming the light emitting phosphor layer 16 was prepared as follows:

Light Emitting Phosphor Layer (16)

To prepare the composition, 18.2 grams of a phosphor additive, zinc sulfide crystals (type #723 from GTE Sylvania, smoothly rounded crystals having particle size of about 15 to 35 microns), were introduced to 10 grams of the PVDF dispersion used above. It was again observed after mixing that despite the smooth shape and relatively high density of the phosphor crystals, the additive particles remained uniformly suspended in the dispersion during the remainder of the process without significant settling.

The composition was superposed by screen printing over the underlying insulator layer 14 through a 280 mesh polyester screen positioned 0.145 inch above the substrate to form a thin layer. The deposited layer was subjected to the two stage drying and fusing procedure described above. Subjecting the layers to temperatures above the melting temperature of the PVDF material caused the PVDF to fuse throughout the newly applied layer and between the layers to form a monolithic unit upon the substrate 12. However, the interpenetration of the material of the adjacent layers having different electrical properties was limited by the process conditions to less than about 5 percent of the thickness of the thicker of the adjacent layers, i.e. to less than about 0.06 mil, so that the different electrical property imparting additive particles remained stratified within the monolithic unit as well as remaining uniformly distributed throughout their respective layers.

The resulting thickness of the dried polymeric layer was 1.2 mils ($1.2\times10^{-3}$ inch).

The deposited film was tested and found to be uniformly luminescent, without significant light or dark spots.

The coating composition for forming the novel semi transparent/conductive front lamp electrode 46 of the invention was prepared as follows:

Semi-Transparent Front Lamp Electrode (18)

To prepare this conductive composition, 13.64 grams of indium oxide particles (Indium Corporation of America, having 325 mesh particle size) were added to 10 grams of the PVDF dispersion described above. An additional amount of carbitol acetate (4.72 grams) was added to lower the viscosity slightly to enhance transfer properties. It was again observed after mixing that the additive particles remained uniformly suspended in the dispersion during the remainder of the process without significant settling.

The composition was superposed onto the light emitting phosphor layer 16 by the screen printing through a 280 mesh polyester screen positioned 0.5 inch thereabove. The substrate with the multiple layers coated thereupon was again heated to above the PVDF melting temperature to cause the semi transparent/conductive front electrode layer to fuse throughout to form a continuous uniform layer and to fuse this layer together with the underlying light-emitting layer to form a monolithic unit.

The resulting thickness of the dried polymeric layer was 0.5 mil ($0.5\times10^{-3}$ inch).

The deposited layer was tested and found to have conductivity of 10 ohm-cm, and to be light transmissive to a substantial degree due to the light transmissivity of the indium oxide particles and of the matrix material.

The coating composition for forming a conductive buss 20 to distribute current via relatively short paths to the electrode was prepared as follows:

Conductive Buss (20)

To prepare this conductive composition, 15.76 grams of silver flake (from Metz Metallurgical Corporation, of 325 mesh #7 particle size) were added to 10 grams of the PVDF dispersion used above. The particles remained uniformly suspended in the dispersion during the remainder of the process without significant settling.

The composition was screen printed through a 320 mesh polyester screen positioned 0.15 inch above semi-transparent upper electrode 18 as a narrow bar extending along one edge of the electrode layer. The deposited layer was subjected to the two stage drying and fusing procedure described above to fuse the PVDF into a continuous smooth film with the silver flake uniformly distributed throughout. was 1.0 mil ($1.0\times10^{-3}$ inch).

The deposited film was tested and found to have conductivity of $10^{-3}$ ohm-cm.

This construction with connecting wires 22, 24 (FIG. 1) and a power source 26, forms functional electroluminescent lamp 10. Electricity is applied to the lamp via the wires and is distributed by the buss layer 20 to the upper electrode 18 to excite the phosphor crystals in the underlying layer 16, which causes them to emit light.

Due, however, to the damaging effect of, e.g., moisture on phosphor layer 16, it is desirable to add a protective and insulative layer 28 about the exposed surfaces of the layers of the lamp to seal to the peripheral surface of the substrate 12, e.g., against penetration of moisture. This layer 28 can also be formed according to the invention, as follows:

Protective Insulative Layer (28)

The PVDF dispersion employed above, devoid of electrical property additives, was screen printed over the exposed surfaces of the lamp 10 through a 180 mesh polyester screen. The lamp was dried for two minutes at 175° F. and heated for 45 seconds at 500° F. The coating and heating procedure was performed twice to provide a total dried film thickness of protective-insulative layer 28 of 1.0 mil. (By using PVDF as the binder material in this and all the underlying layers, each layer has the same processing requirements and restrictions. Thus the upper layers, and the protective coating, may be fully treated without damage to underlying layers, as might be the case if other different binder systems were employed.)

The final heatingstep results in electroluminescent lamp 10 of cross-section as shown in the figures. The polymeric material that was superposed in layers upon flexible substrate 12 has fused within the layers and between the layers to form a monolithic unit about 3.4 mils thick that flexes with the substrate. As all the layers are formed of the same polymeric material, all the layers of the monolithic unit have common thermal expansion characteristics, hence temperature changes during testing did not cause delamination. Also, due to the continuous film-like nature of each layer caused by the fusing of its constituent particles of PVDF and the interpretation of the polymeric material in adjacent layers, including the protective layer 28 covering the top and exposed side surfaces, the lamp is highly resistant to moisture during high humidity testing, and the phosphor crystals did not appear to deteriorate prematurely, as would occur if moisture had penetrated to the crystals in the phosphor layer.

In the following examples, the physical properties of compositions useful according to the invention, prior to the addition of additives, were evaluated.

Viscosity

To determine the approximate range of viscosity prior to addition of additives over which the compositions of the invention are useful, two compositions were prepared using isophorone as the liquid phase and polyvinylidene fluoride (PVDF) powder (461 powder, supplied by Pennwalt), which is substantially insoluble in isophorone, i.e., it is estimated that substantially less than about 5 percent solution occurs. The physical properties of the new compositions were adjusted by addition of PVDF powder or isophorone until the first composition (Composition A) had thickness or body close to the lower end of the range useful for screen printing, and the second composition (Composition B) had body close to the high end of the useful range.

The weight proportions of the compositions and the resultant viscosities are as shown in TABLE A.

TABLE A

| | Composition A | Composition B |
|---|---|---|
| PVDF | 65 | 83 |
| Isophorone | 56 | 58 |
| Wt % solids | 53.4 | 58.9 |
| Viscosity | 17,700 cps | 200,000+ cps |

The viscosities of the compositions were measured using a Brookfield Viscosity Meter, Model LVF, at the #6 (low shear) setting. Composition A was tested using a #3 spindle at a multiplication factor of 200× and gave an average reading of 88.5. Composition B was tested using a #4 spindle at a multiplication factor of 2000× and gave an average reading that appeared well in excess of the maximum reading of 100.

The viscosity of the commercially available Kynar 202 PVDF dispersion (Composition X) was tested on the same equipment and registered a viscosity of approximately 40,000 cps. (It is noted that while the weight percentage of PVDF solids is lower in the commercial product than in either of the test compositions, a different solvent is employed in the commercial system, so strict interpolation is not possible.)

To demonstrate the shear thinning characteristic of the composition, a standard coating composition, in this case a dielectric composition prepared as in Example A, was subjected to further testing. The viscosity of the coating composition was tested in a Brookfield Viscosity Meter, Model LVF, as described above, with a #4 spindle operated at four selected, different speed settings, the speed of the spindle of course being directly proportional to the shear between the spindle and the composition. As shown in TABLE B, the viscosity of the composition decreased dramatically with increased shear.

TABLE B

| Brookfield Viscosity Meter, Model LVF Spindle #4 | | | |
|---|---|---|---|
| Spindle Setting | Multiplier Factor | Reading | Viscosity |
| 6 | 1000 | 50 | 50,000 cps |
| 12 | 500 | 64 | 32,000 cps |
| 30 | 200 | 74 | 14,800 cps |
| 60 | 100 | 86 | 8,600 cps |

Solids Range

The weight percent solids of PVDF will vary depending upon the nature of the carrier fluids employed, and upon the physical properties of the additive, e.g. upon particle surface area (particle shape, spherical or otherwise, as well as particle size) and particle density. The range of PVDF solids present in the overall coating composition can range between about 50 percent, by weight, down to about 15 percent, by weight. The preferred range is between about 25 and 45 percent, by weight.

Other Embodiments

Numerous other embodiments are within the following claims, as will be obvious to one skilled in the art.

The protective layer 28 of the electroluminescent lamp my be applied as preformed film of polyvinylidene fluoride under pressure of 125 pounds per square inch, and the lamp heated at 350° F. for one minute and then cooled while still under pressure. Each separate layer applied may have a dry thickness of as much as 0.010 inch, although thickness in the range between from 0.003 inch down to 0.0001 inch is typically preferred. The protective layer may be applied as preformed film of one or more other materials compatible with the lamp structure, which alone or in combination provide adequate protection against penetration of substances detrimental to performance of the underlying lamp.

Materials which consist essentially of homopolymers of PVDF are preferred. However, other materials may be blended with PVDF, e.g. for improving surface printability, for improving processability during manufacturing, or for improving surface bonding. An example of one material miscible in a blend with PVDF is polymethyl methacrylate (PMMA), e.g. employed at 1 to 15 percent by weight of PVDF, preferably 5 to 10 percent by weight. Also, other materials may be employed in place of PVDF.

Materials which consist essentially of homopolymers of PVDF are preferred. However, other materials may be employed in combination with PVDF or in place of PVDF. An example of one material thought to be useful in combination with PVDF is polymethyl methacrylate (PMMA) employed at 1 to 15 percent by weight of PVDF, preferably 5 to 10 percent by weight.

The guiding criteria for selection of materials for use are low moisture absorptivity, ability of particles to fuse at elevated temperature to form a continuous moisture barrier film, and, when applied to flexible substrate, flexibility and strength. The general physical and mechanical properties of PVDF (in homopolymer for) appear in Table C.

TABLE C

| General Physical and Mechanical Properties of Polyvinylidene Fluoride (PVDF) | | |
|---|---|---|
| Property | ASTM Method | Values |
| Specific Gravity | D 792 | 1.75–1.78 g/ml (109.3–111.3 lb/ft$^3$) |
| Specific Volume | D 792 | 0.56–0.57 ml/g (15.5–15.8 in$^3$/lb) |
| Refractive Index | D 542 | 1.42 nxxx |
| Melting Point | D 3418 | 156–168° C. (312–334° F.) |
| Water Absorption | D 570 | 0.04–0.06% |
| Tensile Strength @ Yield | D 638 | 25° C. 36–51 MPa 100° C. 19–23 MPa (77° F. 5200–7400 psi 212° F. 2700–3400 psi) |
| Tensile Strength @ Break | D 638 | 25° C. 36–52 MPa 100° C. 19–23 MPa (77° F. 5200–7500 psi 212° F. 2700–3400 psi) |
| Elongation @ Break | D 638 | 25° C. (77° F.) 25–500% 100° C. (212° F.) 400–600% |
| Tensile Module | D 638 | 1340–1515 MPa (194–219 × 10$^3$ psi) |
| Stiffness in Flex | D 747 | 1100–1730 MPa (160–250 × 10$^3$ psi) |
| Flexural Strength | D 790 | 59–75 MPa (8.6–10.8 × 10$^3$ psi) |
| Flexural Modulus | D 790 | 1200–1800 MPa (175–260 × 10$^3$ psi) |
| Compressive Strength | D 695 | 25° C. 55–69 MPa (77° F. 8–10 × 10$^3$ psi) |
| Izod Impact (notched) | D 256 | 25° C. 160–530 kJ/m (77° 3.0–10.3 ft-lb/in.) |
| Izod Impact (unnotched) | D 256 | 25° C. 1710–3100 kJ/m (77° F. 32–58 ft-lb/in.) |
| Hardness, Shore | D 2240 | 70–80 |
| Hardness, Knoop | Tukon | 9.4–9.6 |
| Coefficient of Sliding Friction to Steel | | 0.14–0.17 |
| Sand Abrasion | D 968 | 4.01/um (1021/0.0011$^3$) |
| Tabor Abrasion | Wheel C5-17 1000 g | 7.0–9.0 mg/1000 cycles |

The liquid phase of the composition may be selected from the group of materials categorized in the literature as "latent solvents" for PVDF, i.e., those with enough affinity for PvDF to solvate the polymer at elevated temperature, but in which at room temperature PVDF is not substantially soluble, i.e., less than about 5 percent. These include: methyl isobutyl ketone (MIBK), butyl acetate, cyclohexanone, diacetone alcohol, diisobutyl ketone, bytyrolactone, tetraethyl urea, isophorone, triethyl phosphate, carbitol acetate, propylene carbonate, and dimethyl phthalate.

Where addition solution is desired, a limited amount of "active" solvent which can , in greater concentrations, dissolve PVDF at room temperature, e.g., acetone, tetrahydrofuran (THF), methyl ethyl ketone (MEK), dimethyl formamide (DMF), dimethyl acetamide (DMAC), tetramethyl urea and trimethyl phosphate, may be added to the carrier. Such limited amounts are believed to act principally in the manner of a surfactant, serving to link between the PVDF polymer particles and the predominant liquid phase, thus to stabilize the PVDF powder dispersion.

As will also be obvious to a person skilled in the art, the viscosity and weight percent of PVDF solids in the coatingcomposition may also be adjusted, e.g. to provide the desired viscosity, suspendability and transfer characteristic to allow the composition to be useful with additive particles of widely different physical and electrical characteristics.

The additives mentioned above are employed merely by way of example, and it will be obvious to a person skilled in the art that other additives alone or in combination, or other proportions of the additives mentioned may be employed according to the invention where the resulting physical properties, e.g. bulk density or light transmissivity, electrical properties, e.g., bulk resistivity or dielectric constant, of the layer formed are suitable. Additives may be selected on the basis of other criteria, such as cost. The bulk resistivities and bulk densities of examples of materials useful in selected amounts, or in combination with other materials, as additives are shown in TABLE D.

TABLE D

| Material | Resistivity (ohm cm) | Density (gm/cc) |
|---|---|---|
| Gold | $<10^{-6}$ | 19.3 |
| Silver | $<10^{-6}$ | 10.5 |
| Copper | $<10^{-6}$ | 8.9 |
| Brass | $<10^{-6}$ | 8.5 |
| Iron | $<10^{-6}$ | 7.9 |
| Tungsten | $<10^{-5}$ | 19.4 |
| Nickel | $<10^{-5}$ | 8.9 |
| Cobalt | $<10^{-5}$ | 8.6 |
| Stainless Steel | $<10^{-5}$ | 8.0 |
| Tin | $<10^{-5}$ | 6.5 |
| Indium Oxide | ~0.1 | 7.2 |
| Zinc Oxide | ~1.0 | 5.6 |
| Mica powder | $>10^{6}$ | — |
| Aluminum oxide | $>10^{6}$ | 4.0 |

Of course many other suitable materials are available, alloys of the listed metals or others may in some cases be employed in forming the conductive buss, or the front lamp electrode (if, in the proportions employed, the light transmissivity is adequate for the intended application); salts rendered stably semiconductive by the addition of donor or acceptor dopants may in some case be employed in forming the semiconductive layers; and glass (fiber, shot or beads) or clay may in some cases be employed for electrical resistance.

Materials resulting in a composition having a dielectric constant above 15 are useful for forming capacitive dielectrics. Use of additives according to the invention provides a composite layer with electrical characteristics significantly different in degree from that of PVDF above. Examples of materials with sufficiently high dielectric constant are shown in TABLE E for comparison with PVDF.

TABLE E

| Material | Dielectric Constant(approx.) | Density (gm/cc) |
|---|---|---|
| Barium Titanate | 10,000 | 6.0 |
| Strontium Titanate | 200 | 5.1 |
| Titanium Dioxide | 100 | 3.8 |
| PVDF | 10 | 1.8 |

Additive particles suitable for use in formation of the electroluminescent layer include zinc sulfide crystals with deliberately induced impurities ("dopants"), e.g., of copper or magnesium. Representative materials are sold by GTE, Chemical and Metallurgical Division, Towanda, Pa., under the trade designations type 723 green, type 727 green, and type 813 blue green.

What is claimed is:

1. An electroluminescent lamp comprising a phosphor-particle-containing layer disposed between corresponding electtrodes that are adapted to apply an excitation potential to said phosphor particles the upper electrode being light transmissive to radiation from said particles wherein said phosphor layer comprises a thin layer of polymer, the predominant constituent of which is polyvinylidene fluoride (PvDF) in substatantially non-cross-linked state, said layer containing a uniform dispersion of phosphor, said layer being the product of the steps of depositing a fluid dispersion of particles of said polymer and phosphor upon the substrate followed by drying, and said polymer being in a fused, substantially non-cross-liked state continuously through the extent of said layer.

2. An electroluminescent lamp comprising a phosphor-particle-containing layer disposed between corresponding electrodes that are adapted to apply an excitation potential to said phosphor particles, the upper electrode being light transmissive to radiation from said particles, wherein said upper electrode comprises a thin layer of polymer the predominant constituent of which is polyvinylidene fluoride (PVDF) in substantially non-cross-linked stage, said layer containing a uniform dispersion of additional particles that are substantially more electrically conductive than aid polymer, said layer being the product of the steps of depositing a fluid dispersion of a particles of said polymer and said additional particles upon a phosphor-containing layer followed by drying, and said polymer being in a fused, substantially non-cross-linked state continuously throughout the extent of said layer.

3. An electroluminescent lamp comprising a phosphor-particle-containing layer disposed between corresponding electrodes that are adapted to apply an excitation potential to said phosphor particles, the upper electrode being light transmissive to radiation from said particles, said phosphor-containing layer comprising a thin layer of polymer, the predominant constituent of which is polyvinylidene fluoride (PVDF) in substantially non-cross-linked state, said layer containing a uniform dispersion of phosphor, said layer being the product of the steps of depositing a fluid dispersion of particles of said polymer and phosphor upon the substrate followed by drying, and said polymer being in a fused, substantially non-cross-linked state continuously throughout the extent of said layer, and said upper electrode comprising a thin layer of polymer the predominant constituent of which is polyvinylidene fluoride (PvDF) in substantially non-cross-linked state, said layer containing a uniform dispersion of additional particles that are substantially more electrically conductive than said polymer, said layer being the product of the steps of depositing a fluid dispersion of particles of said polymer and said additional particles upon a phosphor-containing layer followed by drying, and said polymer being in a fused, substantially non-cross-linked state continuously throughout the extent of said layer, said polymer of said layers being fused together forming a monolithic unit.

4. The lamp of claim 2 or 3 wherein said electrically conductive particles are transparent, semiconductive particles.

5. The lamp of claim 1, 2 or 3 wherein a said PVDF layer is the result of deposit by high-shear transfer.

6. The lamp of claim 5 wherein said layer is of predetermined, printed form.

7. The lamp of claim 1 wherein said substrate and said deposit thereon comprise a flexible unit.

8. An electroluminescent lamp comprising a phosphor-particle-containing layer;

an upper electrode layer and a lower electrode layer disposed on opposite sides of said phosphor-particle-containing layer, said electrode layers comprising corresponding electrodes that are adapted to apply an excitation potential to said phosphor-particles, the upper electrode layer being light transmissive to radiation from said particles; and an insulating layer disposed between said lower electrode layer and said phosphor-particle-containing layer;

wherein at least one of said layers comprises a polymer whose predominate constitutent is PVDF in substantially non-cross-linked state.

9. The electroluminescent lamp of claim 8 wherien said insulating layer comprises a polymer whose predominate constituent is PVDF in substantially non-cross-linked state.

10. The electroluminescent lamp of claim 8 wherein and insulating layer and said upper electrode layer comprise a polymer whose predominate constituent is PVDF in substantially non-cross-linked state.

11. The electroluminescent lamp of claim 8 wherein at least three of said layers comprise a polymer whose predominate constituent is PVDF in substantially non-cross-linked state.

* * * * *

UNITED STATES PATENT AND TRADEMARK OFFICE

CERTIFICATE OF CORRECTION

PATENT NO. : 4,816,717

DATED : March 28, 1989

INVENTOR(S) : Harper et al.

It is certified that error appears in the above-identified patent and that said Letters Patent is hereby corrected as shown below:

Other Publications

"Technical Date-Solvents for Kynar", delete "(No Date)", and insert --"Kynar". Penwalt Corporation.--

Abstract

Line 11, insert --;-- before "(b)".

In the Specification

Col. 1, line 7, "696.039" should be --696,039--.
Col. 2, line 11, "light emitting" should be --light-emitting--
Col. 3, line 51, "shear thin" should be --shear-thin--.
Col. 4, line 46, "semi should be --semi- --.
Col. 4, line 66, "semi transparent" should be --semi-transparent--.
Col. 5, line 28, after "throughout." insert (new paragraph) --The resulting thickness of the dried polymeric layer--.
Col. 5, line 47, "electrical property" should be --electrical-property--.
Col. 7, line 30, "my" should be --may--.
Col. 8, line 9, "1.42 nxxx$^{25}$" should be --1.42 $n_{\circ}^{25}$--.
Col. 8, lines 29-30, move lines in right column up to directly beneath previous line.
Col. 8, line 48, "PvDF" should be --PVDF--.
Col. 8, line 53, "bytyrolactone" should be --butyrolactone--.
Col. 9, line 1, "coatingcomposition" should be --coating composition--.
Col. 9, line 36, insert --e.g.,-- before "alloys".

UNITED STATES PATENT AND TRADEMARK OFFICE

CERTIFICATE OF CORRECTION

PATENT NO. : 4,816,717

DATED : March 28, 1989

INVENTOR(S) : Harper et al

It is certified that error appears in the above-identified patent and that said Letters Patent is hereby corrected as shown below:

In the Claims

Col. 10, line 4, "electtrodes" should be --electrodes--.
Col. 10, line 5, insert --,-- after "particles".
Col. 10, line 33, "aid" should be --said--.
Col. 10, line 35, delete "a" before "particles".
Col. 10, line 62, "PvDF" should be --PVDF--.
Col. 12, line 10, "wherien" should be --wherein--.

Signed and Sealed this

Thirteenth Day of February, 1990

*Attest:*

JEFFREY M. SAMUELS

*Attesting Officer*

*Acting Commissioner of Patents and Trademarks*